US007391981B2

(12) United States Patent
Okino et al.

(10) Patent No.: US 7,391,981 B2
(45) Date of Patent: Jun. 24, 2008

(54) DEVELOPER SUPPLY CONTAINER AND IMAGE FORMING APPARATUS

(75) Inventors: Ayatomo Okino, Moriya (JP); Yutaka Ban, Tokyo (JP); Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/463,195

(22) Filed: Aug. 8, 2006

(65) Prior Publication Data

US 2007/0036565 A1 Feb. 15, 2007

(30) Foreign Application Priority Data

Aug. 10, 2005 (JP) ..... 2005-231530

(51) Int. Cl.
*G03G 15/08* (2006.01)

(52) U.S. Cl. ..... 399/27; 399/64

(58) Field of Classification Search ..... 399/27, 399/64

See application file for complete search history.

(56) References Cited

U.S. PATENT DOCUMENTS 5,899,597 A * 5/1999 Shinohara et al. ..... 399/64
6,256,459 B1 * 7/2001 Hasegawa et al. ..... 399/27

FOREIGN PATENT DOCUMENTS

JP 9-120209 A 5/1997
JP 2001-312133 A 11/2001
JP 3393965 A 1/2003

* cited by examiner

*Primary Examiner*—David M Gray
*Assistant Examiner*—Bryan Ready
(74) *Attorney, Agent, or Firm*—Fitzpatrick, Cella, Harper & Scinto

(57) ABSTRACT

A developer supply container detachably mountable to a main assembly of an image forming apparatus, with the image forming apparatus including a remaining amount detecting portion for detecting an amount of remaining developer by receiving light from a light emitting portion by a light receiving portion. The developer supply container includes a container body for containing a developer. The developer supply container also includes a light guiding member including an incident portion for receiving light from the light emitting portion and for guiding the light into the container body, an emergent portion for guiding the light having passed through the container body toward the light receiving portion, and a connecting portion connecting the incident portion and the emergent portion.

12 Claims, 7 Drawing Sheets

(A)

(B)

DEVELOPER SUPPLY CONTAINER AND IMAGE FORMING APPARATUS

FIELD OF THE INVENTION AND RELATED ART

The present invention relates to a developer supply container and an image forming apparatus for supplying a developer to an image forming apparatus of an electrostatic recording type and an image forming apparatus or the like such as a copying machine, a printer, a facsimile machine or the like.

Ordinarily, the image forming apparatus such as the electrophotographic copying machine and printer or the like uses a developer which is fine power. When the developer in the main assembly of the image forming apparatus is used up, the developer is supplied into the image forming apparatus using a developer supply container.

Such a developer supply container is provided with detecting means for detecting presence or absence of the developer (developer shortage detecting means) using a member which reflects or transmits light.

With such detecting means, when the developer remains, an optical path is shut by the developer, and when the amount of the developer becomes small, a photo-receptor sensor receives the light, which means shortage of the developer.

However, it is possible that light emitted from the image forming apparatus enters the photo-receptor sensor by way of an unintended optical path, despite the fact that intended optical path is shut off by the existing developer. If this occurs, "no-developer" is detected erroneously.

In order to prevent this occurrence, Japanese Laid-open Patent Application 2001-312133 discloses that light blocking member is used for the portions other than the intended or regular optical path. More particularly, a reflection plate unit including a reflecting portion for reflecting the light and a light blocking portion for blocking the portion except for the regular optical path is set in the developer supply container to detect the developer shortage is detected. With such a structure, the erroneous detection is avoided by preventing the light emitted from the light emitting portion from directly reflecting toward the light receiving portion.

Another example is disclosed in Japanese Patent No. 3393965 wherein the configuration of the reflecting surface is modified so that light in the light emission side is not directly reflected toward the receipt side. Even when the light emitted from the light emitting portion is reflected at a position other than the optical path, the reflected light is redirected away from the light receiving portion.

However, the structure disclosed in aforementioned Japanese Laid-open Patent Application 2001-312133, comprises two parts, namely, a reflection plate case and a reflection plate unit. The light blocking portion and the reflecting portion of the reflection plate unit have to be of different materials, and more particularly one of them has to be colored. This increases the manufacturing cost.

With this structure shown in aforementioned patent No. 3393965, projecting or recessed configuration is necessitated to redirect the light. In addition, since the light is simply redirected, and the light per se is not extinguished, diffused reflection or the like may cause the light to reach the light receiving portion.

SUMMARY OF THE INVENTION

Accordingly, it is a principal object of the present invention to provide a developer supply container and an image forming apparatus wherein erroneous detection of a remaining amount of a developer is prevented with a simple structure.

According to an aspect of the present invention, there is provided a developer supply container detachably mountable to a main assembly of an image forming apparatus including remaining amount detecting means for detecting an amount of remaining developer by receiving light from a light emitting portion by a light receiving portion, said container comprising a container body for containing a developer; a light guiding member including an incident portion for receiving light from the light emitting portion and for guiding the light into said container body, an emergent portion for guiding the light having passed through said container body toward the light receiving portion, and a connecting portion connecting said incident portion and said emergent portion, wherein said connecting portion is provided with an exposing portion for exposing a wall surface of said container body at a portion which reflects the light emergent from the light emitting portion toward the light receiving portion without passing through said incident portion; wherein the wall surface of said container body exposed at the exposing portion has a light reflectance which is smaller than that of said connecting portion.

According to another aspect of the present invention, there is provided an image forming apparatus detachably mountable to a developer supply container, said apparatus comprising image forming means for forming an image on a recording material with a developer; remaining amount detecting means for detecting an amount of remaining developer in said developer supply container by receiving light from a light emitting portion by a light receiving portion;

said developer supply container including, a container body for containing the developer; a light guiding member including an incident portion for receiving light from the light emitting portion and for guiding the light into said container body, an emergent portion for guiding the light having passed through said container body toward the light receiving portion, and a connecting portion connecting said incident portion and said emergent portion, wherein said connecting portion is provided with an exposing portion for exposing a wall surface of said container body at a portion which reflects the light emergent from the light emitting portion toward the light receiving portion without passing through said incident portion; wherein the wall surface of said container body exposed at the exposing portion has a light reflectance which is smaller than that of said connecting portion.

DESCRIPTION OF THE PREFERRED EMBODIMENTS

Referring to the accompanying drawings, a developer supply container and an image forming apparatus usable therewith according to the preferred embodiments of the present invention will be described.

First Embodiment

Figure 1:
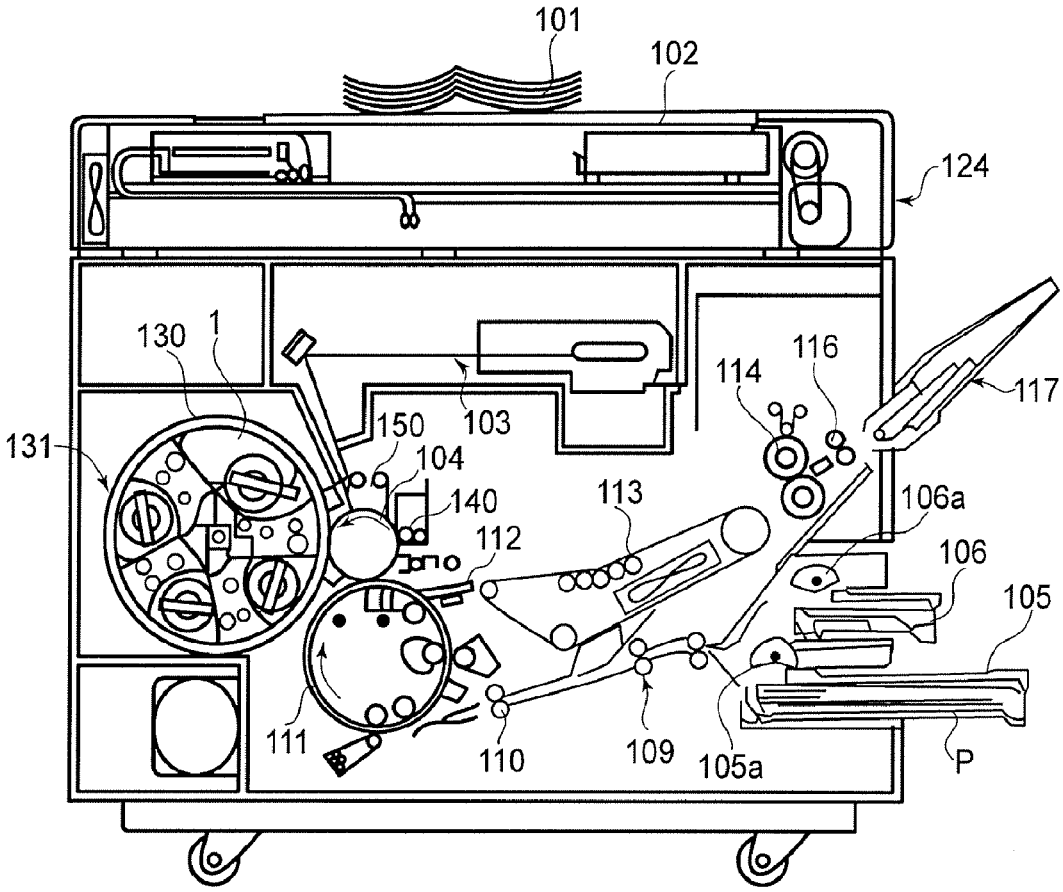
FIG. 1 is a sectional view of an image forming apparatus.

FIG. 1 is a schematic sectional view of an image forming apparatus usable with the developer supply container according to the first embodiment of the present invention.

(General Arrangement of Image Forming Apparatus)

The description will first be made with respect to the general arrangement and operation of the image forming apparatus to which the developer supply container is detachably mountable.

As shown in FIG. 1, there is provided an image forming station including a photosensitive drum 104 and so on wherein the photosensitive drum 104 is exposed to light by an optical portion 103 in accordance with image information so that an electrostatic latent image is formed on the photosensitive drum 104. The image information is obtained from an original 101 set on an original supporting platen glass 102 by an image reader or is provided from another equipment.

On the other hand, recording materials P such as sheets of paper, OHP sheets or the like are stacked in feeding cassettes 105, 106 and are selectively picked up by rollers 105*a*, 106*a* in accordance with information inputted by the operator on an operating portion (unshown). The recording material P singled out of the feeding cassettes 105, 106 is fed to registration rollers 110 by way of a feeding portion 109. The registration rollers 110 once stop the recording material P and refeed the recording material P in timed relation with the scanning of the optical portion 103 taking the rotation of the photosensitive drum 104 into account.

The developed image is formed on the photosensitive drum 104 by a developing device and is transferred onto the recording material P by the transferring means 111. The recording material P is separated from the photosensitive drum 104 by separating means 112 and is fed to a fixing portion 114 on a feeding portion 113. The fixing portion 114 fixes the developed image on the recording material P by heat and pressure. The recording material P after the fixing is discharged onto a discharging tray 117 by discharging rollers 116.

In an electrophotographic image forming apparatus of the above-described structure, there are provided around the photosensitive drum 104 a rotatable member 130 (rotary type developing device) provided with 4 developing devices, cleaning means 140 and primary charging means 150. The developing devices in the rotatable member 130 develop the electrostatic latent image formed on the photosensitive drum 104 using developers at a position opposed to the photosensitive drum 104.

The main assembly 131 of the rotary type developing device of the rotatable member 130 rotatably supported in the main assembly of the image forming apparatus 124 is provided with mounting means for detachably mounting the developer supply containers 1 for supplying the developers into the developing devices, respectively.

Each of the developing devices includes a developing roller disposed slightly spaced from the photosensitive drum 104 at a position facing the photosensitive drum 104. For the developing operation, a thin developer layer is formed on the peripheral surface of the developing roller by a developing blade, and the developing roller it supplied with a developing bias to develop an electrostatic latent image formed on the photosensitive drum 104.

The charging means 203 functions to electrically charge the photosensitive drum 104. The cleaning means 140 functions to remove the developer remaining on the photosensitive drum 104.

Figure 6:
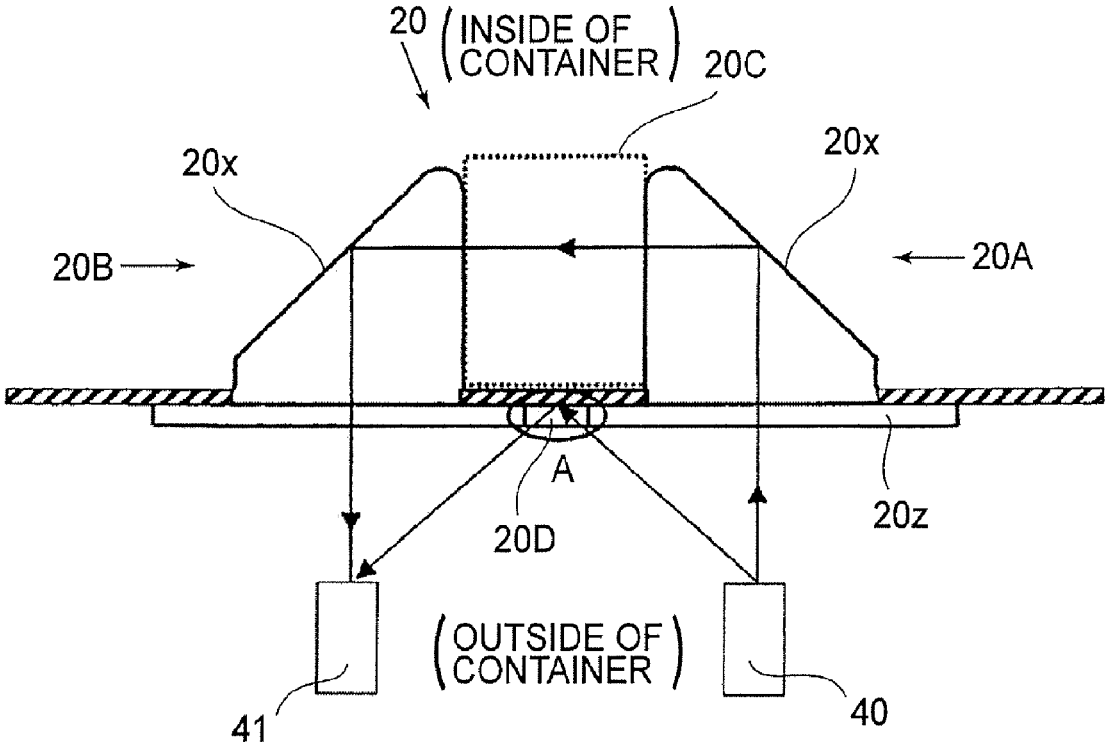
FIG. 6 illustrates a structure for detecting a developer remainder.

The amount of the developer decreases with the developing operation of the developing device. Thus, a developer supply container 1 is mounted in the main assembly of the apparatus to supply the developer into the developing device and is used to supply the developer in response to decrease of the amount of the developer. In order to detect whether or not the developer remains in the developer supply container 1, the developing device is provided with developer remainder detecting means including a light emitting portion 40 (FIG. 6) and a light receiving portion 41 (FIG. 6).

In the developer remainder detecting means, the light from the light emitting portion 40 is transmitted through the developer supply container 1 and is received by the light receiving portion 41 to detect the presence or absence of the developer in the developer supply container 1. More particularly, when the developer exists in the developer supply container 1, the light from the light emitting portion 40 is blocked by developer so that it does not reach the light receiving portion 41, and on the other hand, when the developer does not exist, the light from the light emitting portion 40 reaches the light receiving portion 41. Using the difference in the receipt of the light by the light receiving portion 41, the presence or absence of the developer in the developer supply container 1 is detected.

For the purpose of downsizing the main assembly of the apparatus and reducing the length of the optical path to minimize the loss of light, the light emitting portion 40 and the light receiving portion 41 are disposed adjacent to each other (the distance therebetween is 15 mm in this embodiment).

(Structures of Developer Supply Container)

Figure 2:
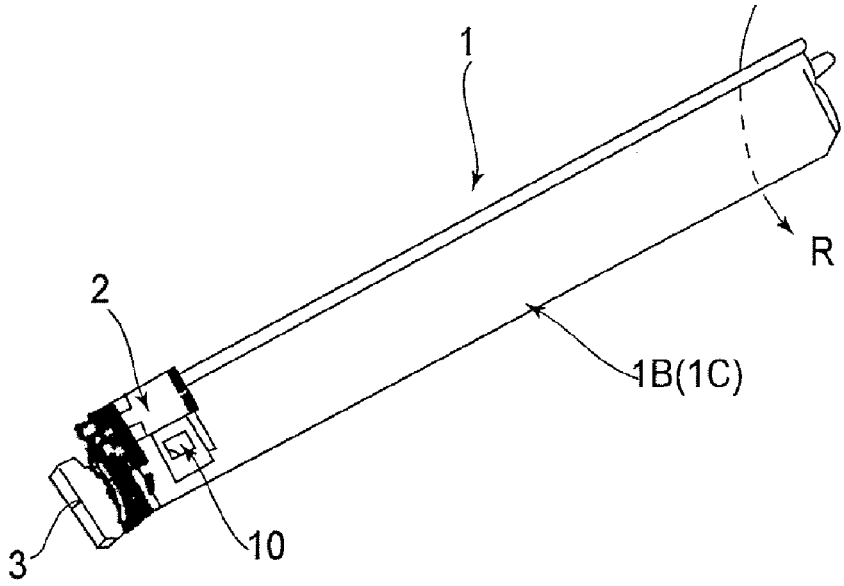
FIG. 2 is a perspective view of a developer supply container.
Figure 3:
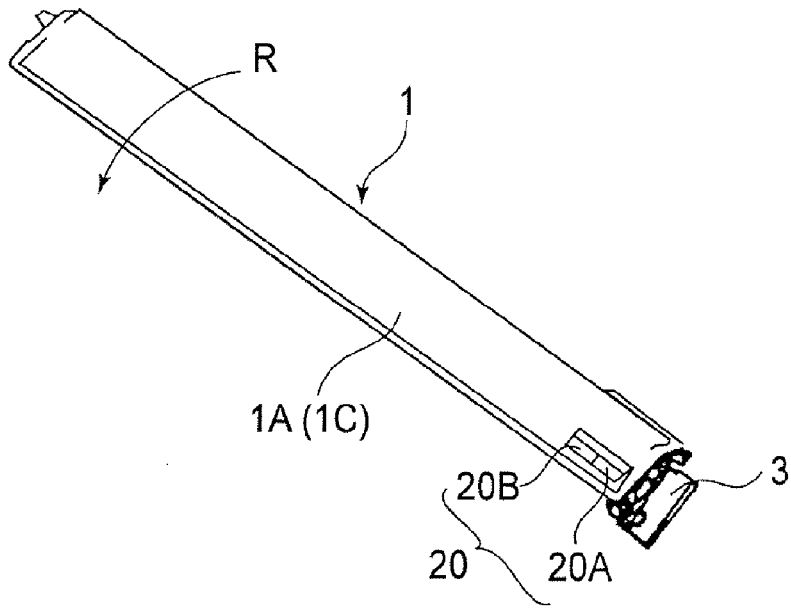
FIG. 3 is a perspective view of a developer supply container.
Figure 4:
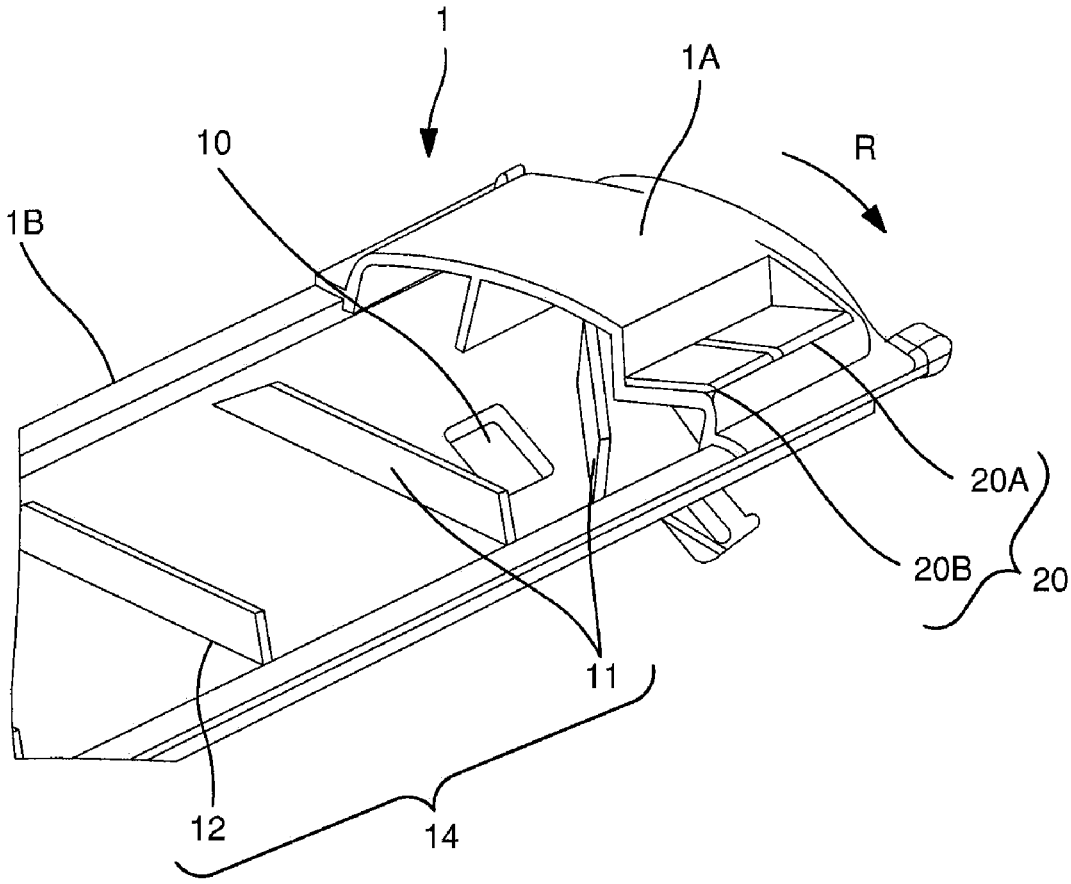
FIG. 4 is a partly broken perspective view of a developer supply container adjacent a developer discharge opening.
Figure 5:
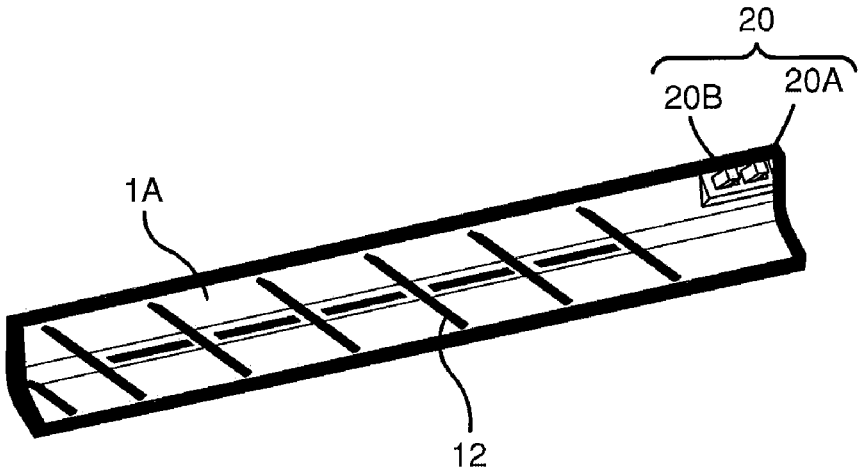
FIG. 5 illustrates a structure for developer feeding in the developer supply container.
Figure 7:
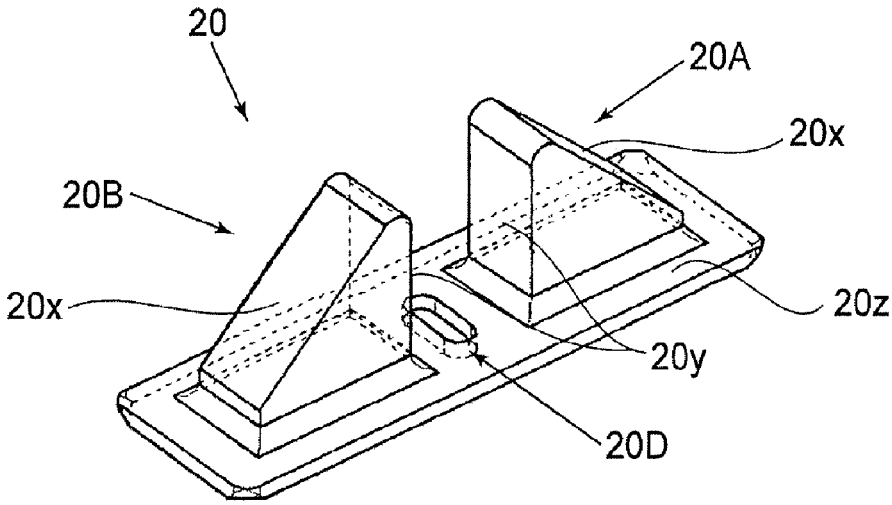
FIG. 7 is a perspective view showing a light guiding member.

Referring to FIG. 2-FIG. 7, the developer supply container 1 will be described. FIGS. 2 and 3 are schematic perspective views of the developer supply container, and FIGS. 4 and 5 are schematic perspective views of insides of the developer supply container. FIGS. 6 and 7 are illustrations of a light guiding member 20.

The developer supply container 1 of this embodiment is mounted on the rotatable member 130, and it supplies the developer into the developing device by feeding and discharging the developer thereinto with the rotation of the rotatable member 30. As shown in FIGS. 2 and 3, the developer supply container 1 comprises an upper container portion 1A and a lower container portion 1B which constitute a cylindrical container body 1C for accommodating the developer.

As shown in FIG. 2, a developer discharge opening 10 is provided adjacent one longitudinal end of the container body 1C (with respect to the direction of the rotational axis of the rotatable member 130) and is provided with a shutter 2 which is openable and closable. The shutter 2 functions to close the discharge opening 10 before the developer supply container 1 is mounted to the rotatable member 130. When the developer supply container 1 is mounted on the rotatable member 130, the shutter 2 is opened by an unshown interrelating mechanism in interrelation with the mounting operation of the developer supply container 1 to open the discharge opening 10. By this, the developer can be supplied from the developer supply container 1 into the developing device through the discharge opening 10. When the developer supply container 1 is removed from the rotatable member 130, the shutter 2 closes the developer discharge opening 10 in interrelation with the dismounting operation of the developer supply container 1. To facilitate handling of the developer supply container 1 in the mounting and demounting, a knob 3 is provided at one end portion of the container body 1C.

As shown in FIG. 4, the inner surface of the container body 1C is provided with a feeding portion 14 for feeding the developer toward the developer discharge opening 10 in the container body 1C and discharging the developer through the discharge opening 10, with rotation of the container body 1C. The feeding portion 14 in this embodiment comprises a feeding projection 12 (FIG. 5) which is provided on the inner surface of the container body 1C and which is inclined relative to the direction of a rotational axis. When the developer supply container 1 rotates with rotation of the rotatable member 130, the developer in the container body 1C is fed, while being stirred, to the discharge opening 10 by the feeding projections 12.

(Structure for Detection of Developer Remainder)

A light guiding member 20 is provided on an outer periphery of the developer supply container 1. The light guiding member 20 is light guide means for directing the light from the light emitting portion 40 to the light receiving portion 41, as shown in FIG. 6. As shown in FIG. 7, the guiding member 20 comprising an incident portion 20A, an emergent portion 20B and a connecting portion 20Z (mounting surface) for connecting them with each other. The incident portion 20A functions to guide the light, emitted by the light emitting portion 40 provided in the main assembly side of the image forming apparatus to which the developer supply container 1 is detachably mounted, into the container body 1C by transmission or reflection. On the other hand, the emergent portion 20B functions to guide the light which is incident on the incident portion 20A and is passed through the container body 1C toward the light receiving portion 41.

In this embodiment, the incident portion 20A and the emergent portion 20B of the light guiding member 20 are made integral with each other, and is bonded or welded on the upper side 1A of the container body 1C. The incident portion 20A and the emergent portion 20B may be separate members, but then, the number of parts becomes larger with the result of an increase in cost, and the positional accuracy is difficult to assure. For this reason, the integral structure is preferable. The integral structure of the incident portion 20A and the emergent portion 20B is effective to improve the positional accuracy between the incident portion 20A and the emergent portion 20B so that detection of the remaining amount of the developer is assured.

As shown in FIG. 4, the light guiding member 20 is disposed at a position to which the developer is fed by the flat-plate like projections 11 after passing through the discharge opening 10 by the rotation of the developer supply container 1 in the direction indicated by an arrow R. The light guiding member 20 is disposed adjacent the discharge opening 10 with respect to the direction of the rotational axis of the developer supply container 1. By doing so, the detection of the remaining amount of the developer is assured in the neighborhood of the discharge opening 10.

In this embodiment, a feeding projection 12 for feeding the developer by rotation of the container body 1C is provided on each of an upper portion 1A and a lower portion 1B of the container. However, the present invention is not limited to the structure in which the developer is fed to the remaining developer amount detection portion 20C which is disposed in a region between the incident portion 20A and the emergent portion 20B and adjacent the discharge opening 10.

In this embodiment, the developer supply container 1 is made of a material exhibiting a lower light reflectance than the material of the light guiding member 20. For example, it is mainly made of a resin material (ABS, polystyrene, polycarbonate material or the like).

As regards the light reflectance sufficient to avoid the erroneous detection of the developer remainder, it is determined in consideration of the light quantity of the light emitting portion 40 of the developing device side, the sensitivity of the light receiving portion 41 and the level of the discrimination line for the detection of the presence/absence of the developer. Theoretically, the light other than that along the regular optical path (the path passing through the incident portion 20A and the emergent portion 20B) is noise disturbing the detection, and therefore, the light reflectance is preferably as small as possible.

Here, the light reflectance of the container body wall surface of the developer supply container 1 used in this embodiment is represented by glossiness. The basic principle of the glossiness measurement is to illuminate the material with a predetermined incident angle and to measure the amount of light reflected by the material. High glossiness means high reflectance. A measuring device used is VG-2000 available from Nippon Denshoku Kabushiki Kaisha. A reference of the glossiness is adjusted using a standard included with the measuring device. The wall surface of the developer supply container 1 of this embodiment exhibits the glossiness of 10.8 with the incident angle of 60°.

The light guiding member 20 used in this embodiment is a solid transparent member of a material having a high refractive index. More particularly, the material is acrylic resin material having a refractive index of 1.50, polystyrene resin material having a refractive index of 1.60, or polycarbonate resin material having a refractive index of 1.59, for example (the refractive index of air is approx. 1.00). Since the light guiding member 20 is a solid member, a reflecting surface (inclined surface 20*x*, for example, in FIG. 7) is provided by using the difference in the light refractive index, and therefore, it is not necessary to stick a particular reflection member, and the number of parts can be reduced so that cost of the device can be reduced.

As shown in FIGS. 6 and 7, the light guiding member 20 comprises an inclined surface 20*x* which is inclined relative to the mounting surface 20*z* and which functions to reflect the light and a vertical surface 20*y* which is substantially perpendicular to the mounting surface 20$z$ and which transmits the light. As shown in FIG. 6, the incident portion 20A and the emergent portion 20B are opposed to each other with respect to the direction of the rotational axis and are disposed inside of the container body 1C (upper portion 1A of the container). A plate having a thickness of 1.5 mm made of polycarbonate material which is the same material as the light guiding member 20 is placed on a wall surface of the developer supply container 1, and the glossiness is measured in the similar manner using the measuring device. The result was 176.2 (glossiness).

The glossiness namely the light reflectance of the wall surface of the container body 1C is lower than that of the light guiding member 20 in this embodiment.

Referring to FIG. 6, the mechanisms of the detection of the developer remainder will be described. The light emitted by the light emitting portion 40 provided in the main assembly of the image forming apparatus is incident on the incident portion 20A and travels to the inclined surface 20$x$ by which it is reflected toward the emergent portion 20B. When the developer exists in the region of the remaining amount detecting portion 20C which is between the incident portion 20A and the emergent portion 20B and which is across the optical path, the light is blocked by the existing developer, and therefore, the light receiving portion 41 provided in the main assembly side of the image forming apparatus does not detect the light. On the other hand, when there is hardly any developer in the region of the remaining amount detection portion 20C, the optical path between the incident portion 20A and the emergent portion 20B is not blocked by anything. In this manner, the light having passed through the incident portion 20A reaches the emergent portion 20B and is reflected by the inclined surface 20$x$. The light is then detected by the light receiving portion 41. Thus, the substantial emptiness of the toner container is detected by the detection of the light by the light receiving portion 41.

As described in the foregoing, the developer remainder in the developer supply container 1 is detected. However, in the case that the light emitting portion 40 and the light receiving portion 41 are disposed closely to each other, the light from the light emitting portion 40 may directly be incident on the light receiving portion 41 bypassing the incident portion 20A and the emergent portion 20B, if the light is reflected by another portion. If this occurs, the light reaches unintentionally to the light receiving portion 41 despite the fact that remaining amount of the developer is enough, although the light should reach to the light receiving portion 41 only in the case of absence of the developer in the developer supply container 1. Thus, the erroneous detection of the absence of the developer occurs.

In the case that the light emitting portion 40 and the light receiving portion 41 are arranged as shown in FIG. 6, a portion A directly reflects the light. In this embodiment, the light guiding member 20 is provided with a through-hole 20D at the direct reflecting position A. By doing so, the wall surface of the container body 1C is exposed at the A portion.

Figure 8:
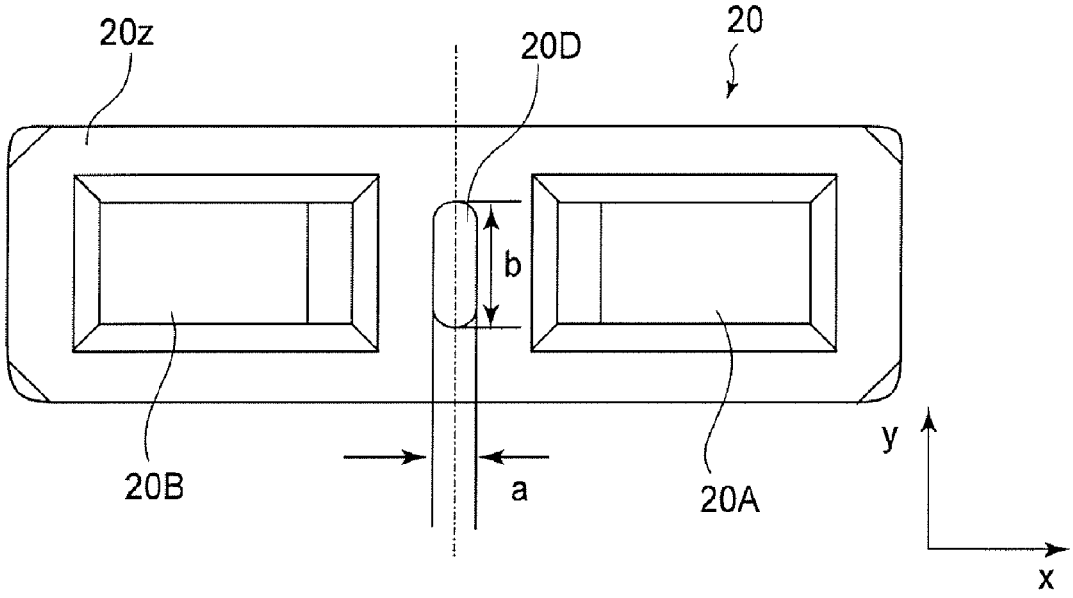
FIG. 8 illustrates a configuration of a hole provided in the light guiding member.

The center of the through-hole 20D in this embodiment, as shown in FIG. 8 is at the center of the light emitting portion 40 and the light receiving portion 41, and the through-hole 20D has a width of 1.8 mm (=a, in the x direction) and a length of 5 mm (b, in the direction y). The through-hole 20D thus permits the wall surface of the developer supply container 1 to expose outwardly.

As described hereinbefore, the wall surface of the container body 1C has a low glossiness, namely, the less reflectance than that of the light guiding member 20. Therefore, the light reflection not along the regular optical path is suppressed, thus preventing the erroneous detection of the developer remainder.

Figure 9:
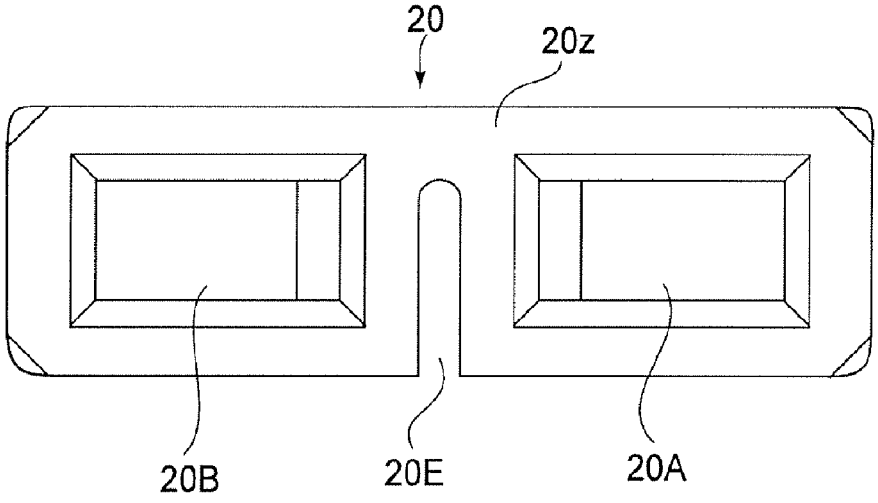
FIG. 9 is illustrates a cut-away portion configuration provided in a light guiding member.

In this embodiment, the exposed portion is provided by the formation of the through-hole 20D, but this is not limiting, and it will surface if the wall surface of the container body 1C is exposed at the position A. In another example, as shown in FIG. 9, the light guiding member 20 may be provided with a cut-away portion 20E to expose the container body wall surface.

As regards the size of the through-hole 20D or the cut-away portion 20E, the larger is the better in the effect of prevention of the detection of the developer remainder. The size, however, is properly determined in consideration of the necessary rigidity of the light guiding member 20.

As described in the foregoing, according to this embodiment, the erroneous detection of the developer remainder can be suppressed with a simple and inexpensive structure, so that absence of the developer in the developer supply container can be accurately detected.

COMPARISON EXAMPLE

Figure 10:
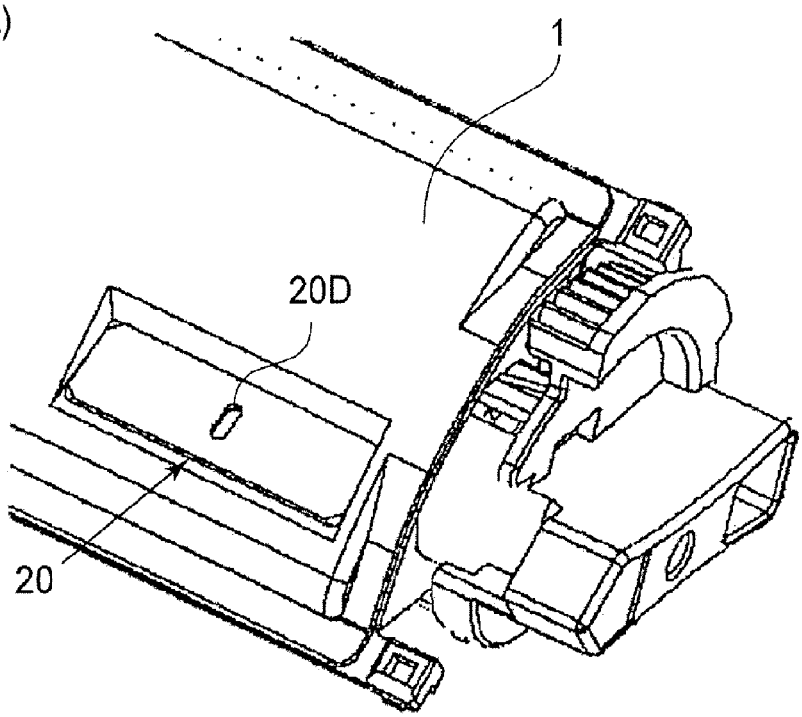
FIG. 10 is a light guiding member (A) according to an embodiment of the present invention and a light guiding member (B) according to a comparison example.
Figure 10:
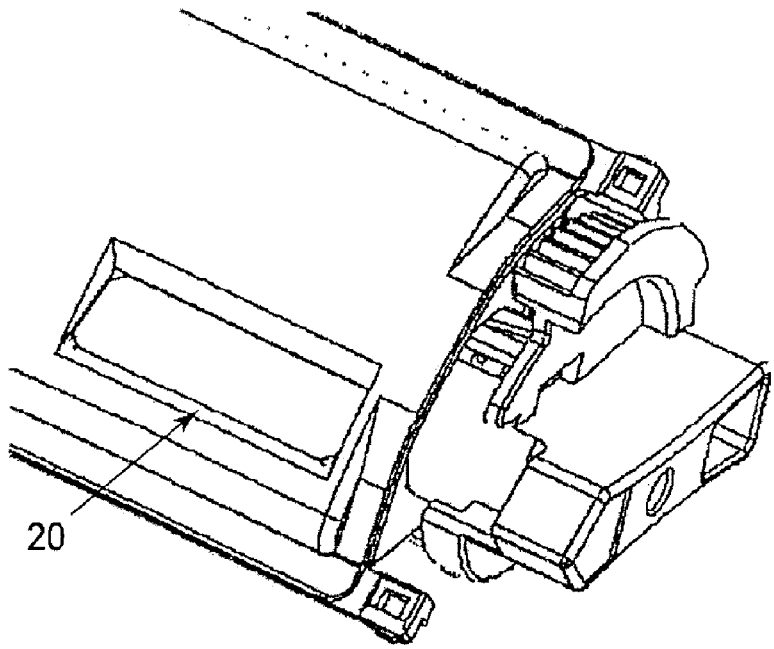

FIG. 10, (B) shows a developer supply container 1 of a comparison example, wherein the light guiding member 20 is not provided with the through-hole 20D, while FIG. 10, (A) shows a developer supply container 1 according to this embodiment. Using these developer supply containers, the developer remainder detection tests were carried out. In the tests, the receipt levels (light sensing levels) of the light receiving portion 41 when the container contains the developer.

The container shown in FIG. 10, (B) is not provided with a through-hole between the incident portion 20A and the emergent portion 20B, and therefore, the wall surface of the developer supply container 1 is not exposed, but the structures thereof are the same as those of this embodiment in the other respects.

The light emitting portion 40 provided in the image forming apparatus side is a light emitting diode supplied with a voltage of 5V, and the light receiving portion 41 is a photo-transistor which provides a current changing with the received light quantity. The boundary receipt level for the discrimination of the presence of the developer is set at 2.5V so that not less than 2.5V of the voltage means absence of the developer.

Therefore, when the amount of the developer remainder is enough, it is preferable that receipt level voltage is low, more particularly, not more than 1.0V, taking into account the variation of the power source voltage, the variation in the positional relation between the light guiding member and the light emitting portion 40 and/or the light receiving portion 41, the variation in the degree of deposition of the developer on the light guiding member, or the like. The voltage is properly set for the apparatus specifications, so that receipt level for the case of the presence of the developer is set.

In the case of the container shown in FIG. 10, (B), the receipt level for the case of the presence of the developer is 1.2V (the difference from the discrimination value between the presence and absence of the developer is 1.3V). On the contrary, in the case of the developer supply container 1 according to this embodiment, the receipt level in the presence of the developer is 0.4V (the difference from the discrimination value between the presence and absence of the developer is 2.1 V).

Therefore, the probability of erroneous detection is lower in the container shown in FIG. 10, (A) than in the container shown in FIG. 10, (b). In this manner, according to these embodiments, the level of the quantity of the light directly reaching the light receiving portion 41 from the light emitting portion 40 when the developer is present in the container, can be assuredly suppressed, so that erroneous detection can be suppressed.

MODIFIED EXAMPLE

Figure 11:
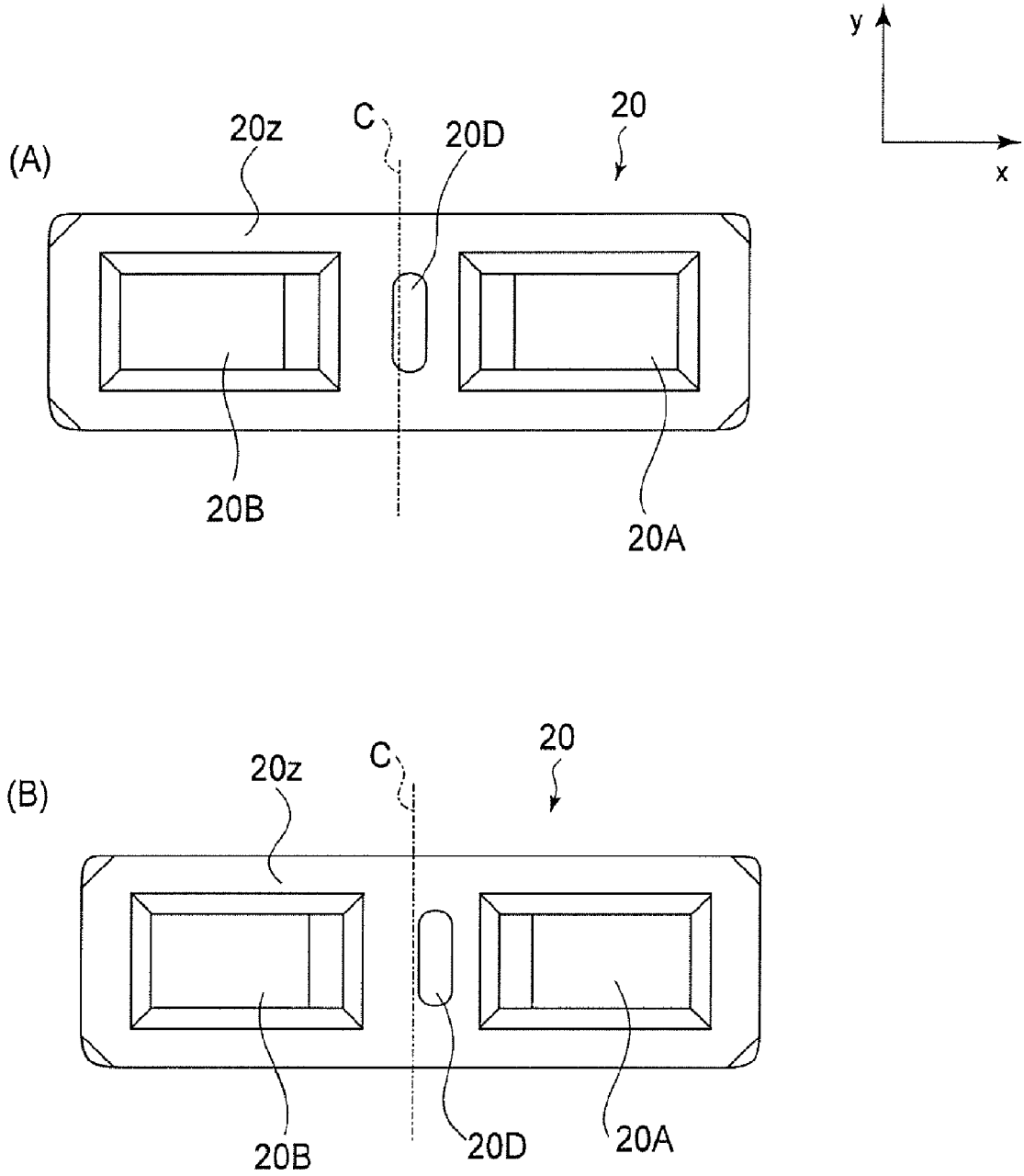
FIG. 11 is an illustration of a structure of another embodiment of the present invention wherein a position of a through-hole provided in the light guiding member is changed.

Referring to FIG. 11, the description will be made as to a developer supply container according to a modified example. As shown in FIG. 11, (A), in the light guiding member 20 of this example, the position of the through-hole 20D is shifted from the middle line C between the incident portion 20A and the emergent portion 20B by 0.5 mm in the direction x, as compared with the foregoing embodiment. In a light guiding member 20 shown in FIG. 11, (B), the position of the through-hole 20D is shifted by 1 mm in the direction x from the middle line between the incident portion 20A and the emergent portion 20B, as compared with the foregoing embodiment.

As described in the foregoing, the structures of the light guiding members 20 of these examples are the same as the structures of the foregoing embodiment except for the shifting of the through-holes 20D.

The light guiding members are mounted on the container body 1C, and the similar tests are carried out. The results of the tests showed that receipt level of the case of the presence of the developer was 0.7 V with the container of FIG. 11, (A) and 1.0 V with the container of FIG. 11, (B).

From the results, it is understood that position of the through-hole 20D, that is, the position of exposure of the container body wall surface is preferably substantially just the middle position between the light emitting portion 40 and a light receiving portion 41.

OTHER EMBODIMENTS

In the foregoing Embodiments, the light guiding member 20 is a transparent and solid member, but the light guiding member is not limited to such a member, may be a transparent and hollow member, for example.

In the foregoing Embodiments, the container body 1C of the developer supply container 1 has a substantially cylindrical shape, but the configuration of the developer supply container is not limited to such a configuration, but may have another configuration.

In the foregoing Embodiments, the exemplary image forming apparatus is a copying machine capable of forming monochromatic and full-color images. For example, the image forming apparatus may be a printer, a facsimile machine or another image forming apparatus, or may be a complex apparatus having a combined function of them. Moreover, the image forming apparatus may be an apparatus in which an intermediary transfer member such as an intermediary transfer belt or an intermediary transfer drum is used, and images developed with different color developers are transferred superimposedly onto the intermediary transfer member, and the developer images are transferred onto a transfer material all at once. Using the above-described developer supply container with such an image forming apparatus, the same advantageous effects are provided.

The number of the developing devices of the image forming apparatus using the developer supply containers is not limited to a particular number. For example, the image forming apparatus may comprise one developing device or may comprise a plurality of developing devices containing different color developers, respectively. The present invention is applicable irrespective of the number of developing devices with the same advantageous effects.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 231530/2005 filed Aug. 10, 2005 which is hereby incorporated by reference.

What is claimed is:

1. A developer supply container detachably mountable to a main assembly of an image forming apparatus, the image forming apparatus including a remaining amount detecting device for detecting an amount of remaining developer by receiving light from a light emitting portion by a light receiving portion, said developer supply container comprising:

a container body for containing a developer; and a light guiding member including an incident portion for receiving light from the light emitting portion and for guiding the light into said container body, an emergent portion for guiding the light having passed through said container body toward the light receiving portion, and a connecting portion connecting said incident portion and said emergent portion, wherein said light guiding member is mounted to said container body so that said connecting portion covers a part of an exterior wall surface of said container body, wherein said connecting portion is provided with a through hole for exposing the exterior wall surface of said container body at a portion which reflects the light emergent from the light emitting portion toward the light receiving portion without passing through said incident portion, and wherein said container body is constituted by a member having a light reflectance which is lower than that of said connecting portion so that the exterior wall surface of said container body exposed at the through hole has a light reflectance that is smaller than that of said connecting portion.

2. A developer supply container according to claim 1, wherein said incident portion, said emergent portion and said connecting portion are integral with each other.

3. A developer supply container detachably mountable to a main assembly of an image forming apparatus, the image forming apparatus including a remaining amount detecting device for detecting an amount of remaining developer by receiving light from a light emitting portion by a light receiving portion, said developer supply container comprising;

a container body for containing a developer; and a light guiding member including an incident portion for receiving light from the light emitting portion and for guiding the light into said container body, an emergent portion for guiding the light having passed through said container body toward the light receiving portion, and a connecting portion connecting said incident portion and said emergent portion, wherein said light guiding member is mounted to said container body so that said connecting portion covers a part at an exterior wall surface of said container body, wherein said connecting portion is provided with a cut-away portion for exposing the exterior wall surface of said container body at a portion which reflects the light emergent from the light emitting portion toward the light receiving portion without passing through said incident portion, and wherein said container body is constituted by a member having a light reflectance which is lower than that of said connecting portion so that the exterior wall surface of said container body exposed at the cut-away portion has a light reflectance that is smaller than that of said connecting portion.

4. A developer supply container according to claim 1 or 2, wherein said incident portion and said emergent portion are disposed adjacent a discharge opening for discharging the developer from said container body.

5. A developer supply container according to claim 1, wherein the through hole is disposed substantially at a center between said incident portion and said emergent portion.

6. A developer supply container according to claim 1 or 2, wherein said light guiding member has a refractive index which is higher than that at air.

7. An image forming apparatus detachably mountable to a developer supply container, said image forming apparatus comprising:

an image forming device for forming an image on a recording material with a developer;

a remaining amount detecting device for detecting, an amount of remaining developer in said developer supply container by receiving light from a light emitting portion by a light receiving portion;

said developer supply container including;

a container body for containing the developer; and a light guiding member including an incident portion for receiving light from the light emitting portion and for guiding the light into said container body, an emergent portion for guiding the light having passed through said container body toward the light receiving portion, and a connecting portion connecting said incident portion and said emergent portion, wherein said light guiding member is mounted to said container body so that said connecting portion covers a part of an exterior wall surface of said container body, wherein said connecting portion is provided with a through hole for exposing the exterior wail surface of said container body at a portion which reflects the light emergent from the light emitting portion toward the light receiving portion without passing through said incident portion, and wherein said container body is constituted by a member having a light reflectance which is lower than that of said connecting portion so that the exterior wall surface of said container body exposed at the through hole has a light reflectance that is smaller than that of said connecting portion.

8. An apparatus according to claim 7, wherein said incident portion, said emergent portion and said connecting portion are integral with each other.

9. An image forming apparatus detachably mountable to a developer supply container; said image forming apparatus comprising:

an image forming device for forming an image on a recording material with a developer;

a remaining amount detecting device for detecting an amount of remaining developer in said developer supply container by receiving light from a light emitting portion by a light receiving portion;

said developer supply container including:

a container body for containing the developer; and a light guiding member including an incident portion for receiving light from the light emitting portion and for guiding the light into said container body, an emergent portion for guiding the light having passed through said container body toward the light receiving portion, and a connecting portion connecting said incident portion and said emergent portion, wherein said light guiding member is mounted to said container body so that said connecting portion covers a part of an exterior wall surface of said container body, wherein said connecting portion is provided with a cut-away portion for exposing the exterior wall surface of said container body at a portion which reflects the light emergent from the light emitting portion toward the light receiving portion without passing through said incident portion, and wherein said container body is constituted by a member having a light reflectance which is lower than that of said connecting portion so that the exterior wall surface of said container body exposed at the cut-away portion has a light reflectance that is smaller than that of said connecting portion.

10. An apparatus according to claim 7 or 8, wherein said incident portion and said emergent portion are disposed adjacent a discharge opening for discharging the developer from said container body.

11. An apparatus according to claim 7, wherein the through hole is disposed substantially at a center between said incident portion and said emergent portion.

12. An apparatus according to claim 7 or 8, wherein said light guiding member has a refractive index which is higher than that of air.

* * * * *

UNITED STATES PATENT AND TRADEMARK OFFICE

CERTIFICATE OF CORRECTION

PATENT NO. : 7,391,981 B2
APPLICATION NO. : 11/463195
DATED : June 24, 2008
INVENTOR(S) : Ayatomo Okino et al.

It is certified that error appears in the above-identified patent and that said Letters Patent is hereby corrected as shown below:

COLUMN 1

Line 15, “power.” should read --powder.--.

COLUMN 10

Line 53, “ing.” should read --ing:--.

COLUMN 11

Line 19, “at” should read --of--.
Line 25, “detecting,” should read --detecting--.
Line 29, “including;” should read --including:--.
Line 42, “wail” should read --wall--.

COLUMN 12

Line 5, “container;” should read --container,--.

Signed and Sealed this

Ninth Day of December, 2008

JON W. DUDAS
*Director of the United States Patent and Trademark Office*